US005579838A

United States Patent [19]

Michael

[11] Patent Number: 5,579,838

[45] Date of Patent: Dec. 3, 1996

[54] ABOVE PRODUCTION DISPOSAL TOOL

[75] Inventor: Clarence Michael, Pratt, Kans.

[73] Assignee: Enviro-Tech Tools, Inc., Pratt, Kans.

[21] Appl. No.: 511,950

[22] Filed: Aug. 7, 1995

[51] Int. Cl.[6] ..... E21B 43/40; E21B 43/38

[52] U.S. Cl. ..... 166/106; 166/186; 166/313

[58] Field of Search ..... 166/105, 105.5, 166/106, 313, 369, 186

[56] References Cited

U.S. PATENT DOCUMENTS

| | | | |
|---|---|---|---|
| 2,281,801 | 5/1942 | Reynolds et al. | 166/306 |
| 2,297,020 | 9/1942 | Page | 166/186 X |
| 2,625,882 | 1/1953 | Davis et al. | 166/54.1 |
| 2,973,035 | 2/1961 | Brown | 166/46 |
| 3,170,520 | 2/1965 | Arutunoff | 166/65 |
| 3,224,267 | 12/1965 | Harlan et al. | 73/155 |
| 4,019,576 | 4/1977 | Finch | 166/250 |
| 4,162,705 | 7/1979 | Daigle | 166/186 |
| 4,192,378 | 3/1980 | Baker et al. | 166/186 |
| 4,296,810 | 10/1981 | Price | 166/106 X |
| 4,766,957 | 8/1988 | McIntyre | 166/106 X |
| 4,815,791 | 3/1989 | Schmidt et al. | 299/4 |
| 5,014,787 | 5/1991 | Duerksen | 166/303 |
| 5,127,457 | 7/1992 | Stewart et al. | 166/306 |
| 5,296,153 | 3/1994 | Peachey | 210/787 |
| 5,366,011 | 11/1994 | Jennings, Jr. | 166/369 X |
| 5,425,416 | 5/1995 | Hammeke et al. | 166/105.5 |
| 5,497,832 | 3/1996 | Stuebinger et al. | 166/369 |

FOREIGN PATENT DOCUMENTS

| | | | |
|---|---|---|---|
| 126836 | 3/1959 | U.S.S.R. | 166/45 A |

OTHER PUBLICATIONS

W. D. Moore III, "ARCO Drills Horizontal Drainhole for Better Reservoir Placement" Oil & Gas Journal, Sep. 15, 1980 pp. 139–.

*Primary Examiner*—Hoang C. Dang
*Attorney, Agent, or Firm*—John R. Flanagan

[57] ABSTRACT

An above production disposal tool for use in a production well having a lower production formation and an upper disposal formation includes an outer tube body, upper and lower annular seals, an upper tube member, an upper collar having a plurality of outlet port holes, a lower tube member, a lower collar having a plurality of inlet port holes, an upper inner by-pass tube, a lower inner by-pass tube, a middle collar disposed between upper and lower tube portions of the outer tube body and having a plurality of axial passageways and a plurality of transverse ports, and a tubing pump having an intake port located below the production formation. The outer tube body, upper and lower tube members and tubing pump are incorporated in a tubing string disposed in the production well with the outer tube body extending along the disposal formation which is sealed above and below by the annular seals. Desired light fluid enters an inner annular passage defined between the inner by-pass tubes and the outer tube body through the inlet port holes below the lower seal and exits above the upper seal through the outlet port holes, by-passing the disposal formation. Undesired heavier fluid is pumped through the intake port into an interior passage defined by the upper and lower tube members and the upper and lower by-pass tubes and out the transverse ports of the middle collar into the disposal formation.

19 Claims, 3 Drawing Sheets

ABOVE PRODUCTION DISPOSAL TOOL

BACKGROUND OF THE INVENTION

1. Field of the Invention

The present invention generally relates to the separation and disposal of an undesired heavier fluid, such as water, from a desired lighter fluid, such as oil and/or gas, below ground surface in a production well and, more particularly, is concerned with an above production disposal tool which disposes an undesired heavier fluid, such as water, in a disposal formation above a production formation.

2. Description of the Prior Art

In addition to producing a desired lighter fluid, such as oil and/or gas, production wells also often yield substantial quantities of an undesired heavier fluid, such as water (including salt water). Co-produced undesired fluids must be separated and properly disposed of; however, the cost of handling and disposing of undesired fluids is significant and therefore impacts the economic feasibility of production wells, especially marginal wells.

Traditionally, undesired fluids have been pumped to the surface along with desired fluids then separated from the desired fluids and transported, often by truck, to another location where they are pumped down a separate well into a subterranean disposal formation. This "surface approach" is inappropriate for many production wells not only because it is very costly, but also because it raises the potential for adverse environmental impacts due to the possibility of an inadvertent escape of undesired fluids during transport and disposal.

Alternatively, undesired fluids can be separated from desired fluids in the production well below ground surface and pumped into a disposal formation without ever bringing the undesired fluids to the surface. This "in-situ" approach eliminates the need to transport the undesired fluids to a separate disposal well, thereby reducing disposal costs and reducing the environmental risks associated with disposal of undesired fluids. The "in-situ" approach, however, requires the availability of an appropriate disposal formation.

U.S. Pat. No. 5,425,416 to Michael N. Hammake et al, assigned to the assignee of the present invention, discloses a down-hole injection tool for down-bore in-situ disposal. This particular tool accomplishes the "in-situ" disposal of undesired fluids, but it requires the availability of a disposal formation below the production formation into which the undesired fluids can be injected. Many times, a disposal formation is not available below the production formation because one does not exist or, as is more often the case, the well bore and casing are not of sufficient depth to reach a disposal formation below the production formation and it is cost prohibitive to extend the well bore and casing. Nevertheless, in many production wells, appropriate disposal formations are available above the production formation and undesired fluids may be transferred from the lower production formation into the upper formation via the existing well bore to accomplish "in-situ" disposal of the undesired fluids.

Assemblies exist that are capable of transferring fluids from a lower formation to an upper formation. One example is disclosed in U.S. Pat. No. 3,170,520 to Arutunoff. The dual-flow transfer assembly disclosed in the Arutunoff patent may be utilized to introduce fluids produced in a lower formation into an upper formation. However, the Arutunoff assembly does not provide separate passageways for the movement of desired fluids, such as oil and/or gas, and the movement of undesired fluids, such as water. Thus, it is not capable of simultaneously bringing desired fluids from a lower production zone to the surface and disposing of undesired fluids from the same lower production zone in an upper disposal formation.

Consequently, a need still exists for a tool which may be utilized to simultaneously accomplish delivery of desired fluids from a production formation to the ground surface and "in-situ" disposal of undesired fluids produced in the same production formation into a disposal formation above the production formation.

SUMMARY OF THE INVENTION

The present invention provides an above production disposal tool designed to satisfy the aforementioned needs by avoiding the drawbacks of the prior art without introducing other drawbacks. The above production disposal tool of the present invention basically includes an outer tube body including an intermediate collar, upper and lower annular sealing means, an upper tube member, an upper collar between the upper tube member and outer tube body and having a plurality of outlet port holes, a lower tube member, a lower collar between the lower tube member and outer tube body and having a plurality of inlet port holes, an upper inner by-pass tube, a lower inner by-pass tube, a plurality of axial passageways defined in the middle collar, a plurality of transverse ports defined in the middle collar, and a down-hole tubing pump.

One feature of the above production disposal tool of the present invention is that the outer tube body, upper tube member and lower tube member are disposed in a well casing of a production well and incorporated in a tubing string so that the outer tube body located between the upper and lower tube members extends along a disposal formation. An outer annulus is defined between the well casing and the outer tube body, upper tube member and lower tube member. The upper and lower annular sealing means form a seal between respective upper and lower end portions of the outer tube body above and below the disposal formation so that the outer annulus is divided into separate upper, middle and lower portions. The outer lower annulus extends below the lower annular sealing means and along the production formation. The outer upper annulus extends upward from the upper annular sealing means to the ground surface.

Another feature of the above production disposal tool of the present invention is that lighter desired fluids will flow from the outer lower annulus to the outer upper annulus, by-passing outer middle annulus, and thereby allowing desired fluids to be brought from the production formation to the ground surface, by-passing the disposal formation. The upper and lower inner by-pass tubes are disposed within the outer tube body so that upper and lower annular passages are defined between the upper and lower inner by-pass tubes and the outer tube body. The lower by-pass tube extends into the lower collar so that the lower annular passage communicates with the inlet port holes of the lower collar and the upper by-pass tube extends into the upper collar so that the upper annular passage communicates with the outlet port holes of the upper collar. The upper and lower annular passages are connected by the axial passageways defined in the middle collar. Desired fluids flow from the outer lower annulus through the inlet port holes, up the lower inner annular passage, up through the axial passageways, up the outer upper annular passage and out the outlet port holes into the outer upper annulus.

A further feature of the above production disposal tool of the present invention is that undesired fluids are pumped from the outer lower annulus into the disposal formation. The upper and lower tube members and the upper and lower inner by-pass tubes define an interior passage that communicates with the transverse ports of the middle collar. Undesired fluids enter the outer lower annulus from the production formation and flow downward and thus are separated from the desired fluids by the force of gravity since the undesired fluids are heavier. The undesired fluids are pumped through an intake port of the pump below the production formation into the interior passage and out the transverse ports of the middle collar into the outer middle annulus and the disposal formation. The upper and lower annular sealing means prevent undesired fluids from flowing from the outer middle annulus into either the outer lower annulus or the outer upper annulus.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
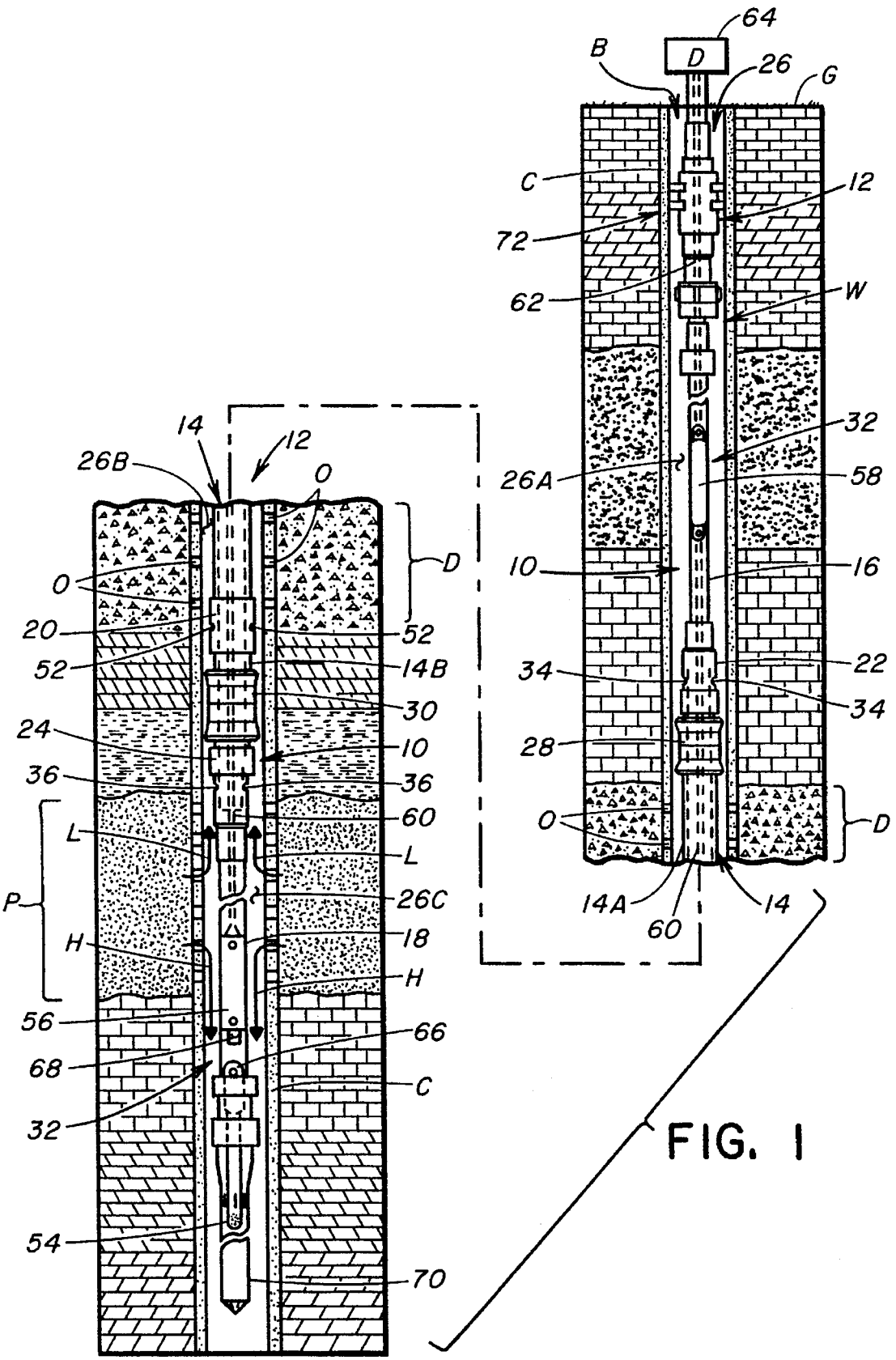
FIG. 1 is a vertical sectional view of a well bore of a production well in which an above production disposal tool of the present invention is installed.
Figure 2:
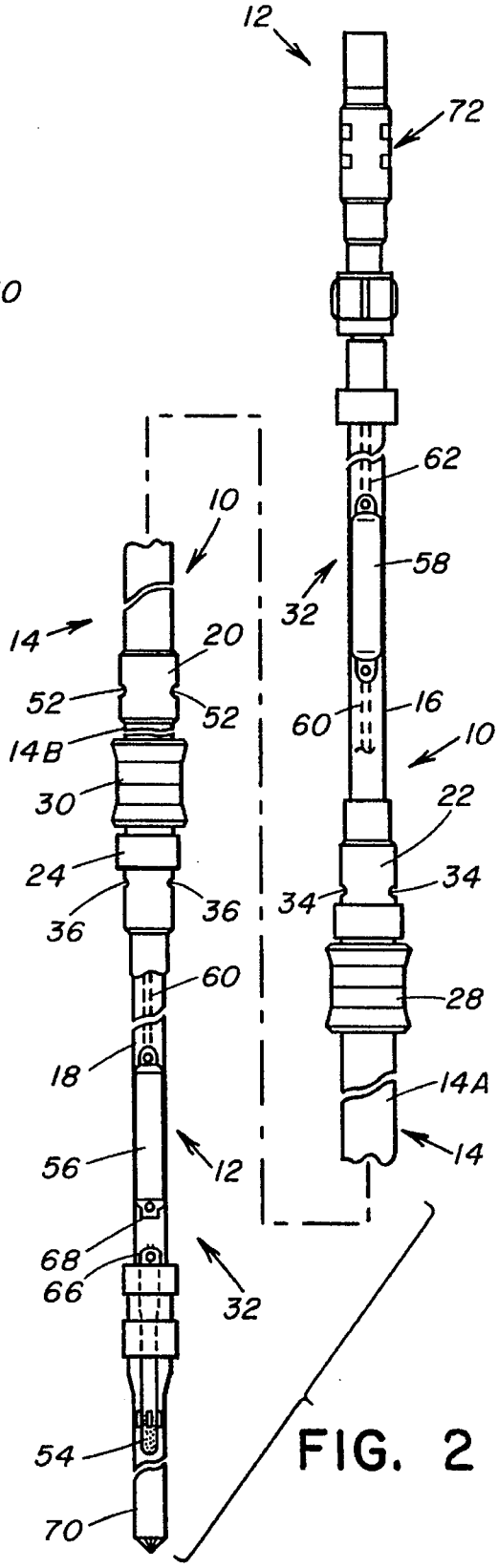
FIG. 2 is a side elevational view of the above production disposal tool of the present invention.

Referring to the drawings, and particularly to FIGS. 1 and 2, there is illustrated, in a vertical sectional representation, a well bore B of a production well W formed through an upper disposal formation D and a lower productive formation P and having an elongated tubular well casing C extending downwardly from ground surface G through the upper disposal formation D to below the lower productive formation P. Openings 0 are provided in the casing C at the respective elevations of the upper disposal formation D and the lower production formation P so as to establish flow communication between the respective formations D, P and the interior of the casing C. The lower productive formation P yields both a desired lighter fluid, such as oil and/or natural gas as represented by arrows L, and an undesired heavier fluid, such as mineral-laden water as represented by arrows H, into the interior of the casing C.

In accordance with the present invention, an above production disposal tool, generally designated 10, is installed in the well bore B. The above production disposal tool 10 simultaneously delivers desired lighter fluids L from the lower productive formation P to ground surface G and accomplishes in-situ disposal of undesired heavier fluids H in the upper disposal formation D.

The above production disposal tool 10 includes a tubing string 12 having an outer tube body 14, an upper tube member 16 and a lower tube member 18. The tubing string 12 is disposed in the well casing C so that the outer tube body 14 extends along the disposal formation D. The outer tube body 14 includes an upper tube portion 14A, a lower tube portion 14B and a middle collar 20 disposed between and connected with respective lower and upper ends of the upper and lower tube portions 14A, 14B. The tubing string 12 also includes an upper collar 22 disposed between and connected with a lower end of the upper tube member 16 and an upper end of the upper tube portion 14A of the outer tube body 14 such that the upper collar 22 and upper tube member 16 extend upwardly therefrom. The tubing string 12 further includes a lower collar 24 disposed between and connected with an upper end of the lower tube member 18 and a lower end of the lower tube portion 14B of the outer tube body 14 such that the lower collar 24 and lower tube member 18 extend downwardly therefrom. An outer annulus 26 is defined between the well casing C and the tubing string 12.

Figure 7:
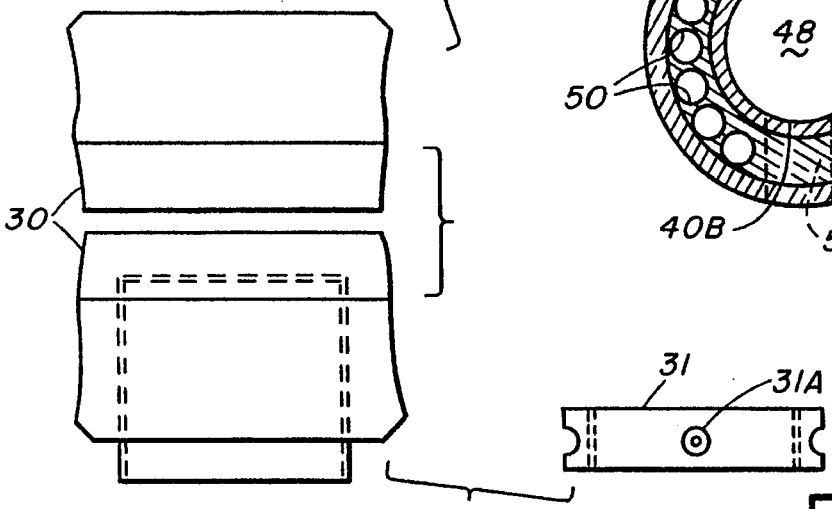
FIG. 7 is an enlarged exploded elevational view of a lower mandrel portion of an outer tube body and a lower packer seal of the above production disposal tool of the present invention.

The above production disposal tool 10 also includes upper and lower annular sealing means, such as a pair of upper and lower packer seals 28, 30. The upper packer seal 28 is disposed about the upper tube portion 14A of the outer tube body 14 adjacent to the upper end thereof and above the disposal formation D, while the lower packer seal 30 is disposed about the lower tube portion 14B of the outer tube body 14 adjacent to the lower end thereof and below the disposal formation D. In accordance with one example illustrated in FIG. 7, the lower packer seal 30 can slidably fit over the lower tube portion 14B of the outer tube body 14 and be retained thereon by a coupler ring 31 having a set screw 31A for securing the ring 31 to the lower tube portion 14B. The upper packer seal 28 may likewise be fitted over the upper tube portion 14A of the outer tube body 14. The upper and lower packer seals 28, 30 each form an annular seal between the outer tube body 14 and the well casing C dividing the outer annulus 26 into an outer upper annulus 26A defined between the well casing C and the upper tube member 16, an outer middle annulus 26B defined between the well casing C and the outer tube body 14, and an outer lower annulus 26C defined between the well casing C and the lower tube member 18.

Also, the above production disposal tool 10 includes a down-hole tubing pump 32. The tubing pump 32 is incorporated in the lower tube member 18 and extends downwardly therewith along the outer lower annulus 26C to below the productive formation P. As will be described below, the pump 32 is incorporated also in the upper tube member 16 so that the pump 32 extends upward above the disposal formation D.

Figure 4:
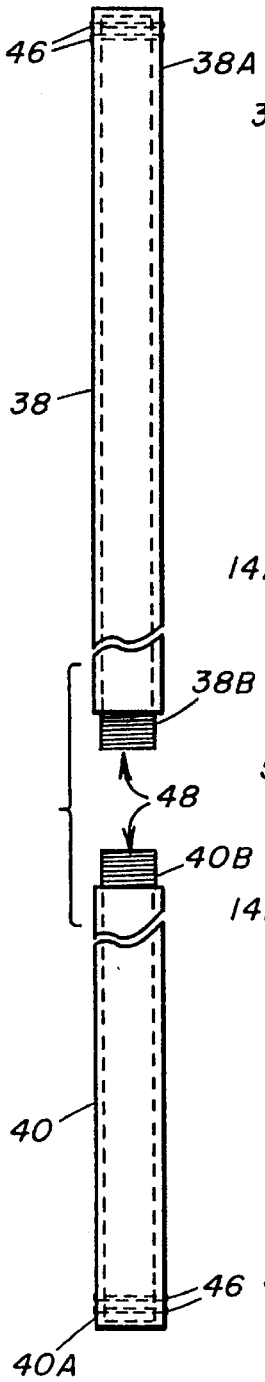
FIG. 4 is an enlarged side elevational view showing upper and lower inner by-pass tubes of the above production disposal tool of the present invention.
Figure 3:
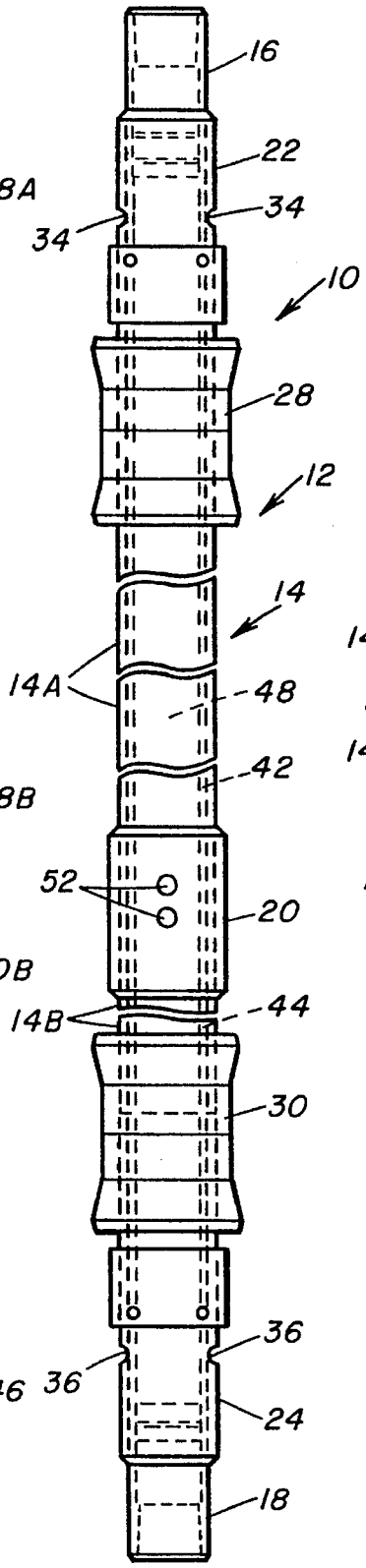
FIG. 3 is an enlarged side elevational view of the above production tool of the present invention.

Referring now to FIGS. 3 and 4, the upper collar 22 has a plurality of outlet port holes 34 defined therein for discharging the desired lighter fluids L flowing upwardly in the outer tube body 14 into the outer upper annulus 26A above the upper packer seal 28 for discharge up the well casing to the ground surface G and from the production well W. The lower collar 24 has a plurality of inlet port holes 36 defined therein for receiving the desired lighter fluids L flowing upwardly in the outer lower annulus 26C from the production formation P toward the lower packer seal 30.

The above production disposal tool 10 further includes upper and lower inner by-pass tubes 38, 40 disposed rspectively within the upper and lower tube portions 14A, 14B of the outer tube body 14. The upper inner by-pass tube 38 is thus located above the middle collar 20, whereas the lower inner by-pass tube 40 is located below the middle collar 20. An upper inner annular passage 42 is defined between the upper inner by-pass tube 38 and the upper tube portion 14A of the outer tube body 14. The upper end 38A of the upper inner by-pass tube 38 extends upwardly into the upper collar 22 so that the upper inner annular passage 42 communicates with the outlet port holes 34 of the upper collar 22. A lower inner annular passage 44 is defined between the lower inner by-pass tube 40 and the lower tube portion 14B of the outer tube body 14. The lower end 40A of the lower inner by-pass tube 40 extends downwardly into the lower collar 24 so that the lower inner annular passage 44 communicates with the inlet port holes 36 of the lower collar 24. The upper inner by-pass tube 38 is adapted to threadably attach at its upper end 38A to the upper collar 22 and at its lower end 38B to the middle collar 20. Likewise, the lower inner by-pass tube 40 is adapted to threadably attach at its lower end 40A to the lower collar 24 and at its upper end 40B to the middle collar 20. Respective O-rings 46 are fitted over the upper end 38A of the upper inner by-pass tube 38 and the lower end 40A of the lower inner by-pass tube 40 to form respective annular seals where the inner by-pass tubes 38, 40 join the upper and lower collars 22, 24. This prevents leakage of desired fluids L from the upper and lower inner annular passages 42, 44 into an interior passage 48 defined by interiors of the upper and lower tube members 16, 18, the middle collar 20, and the upper and lower inner by-pass tubes 38, 40.

Figure 5:
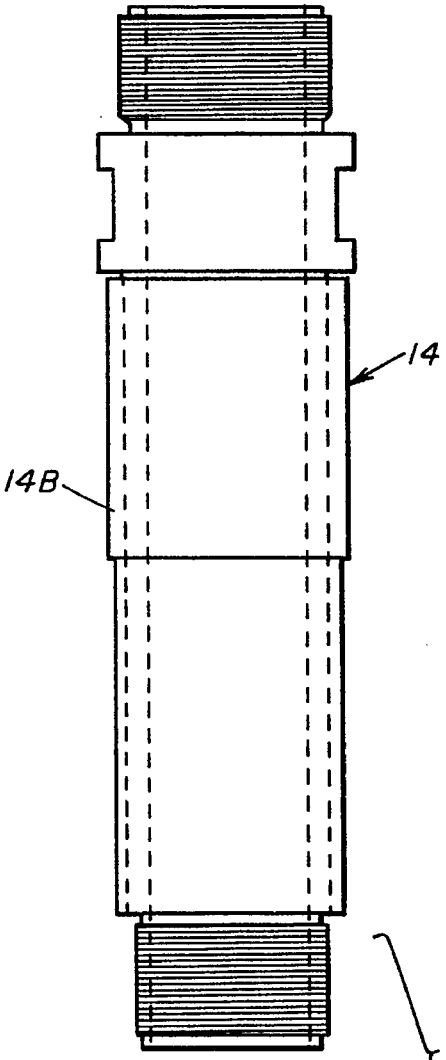
FIG. 5 is an enlarged side elevational view showing a middle collar of the above production disposal tool of the present invention.
Figure 5:
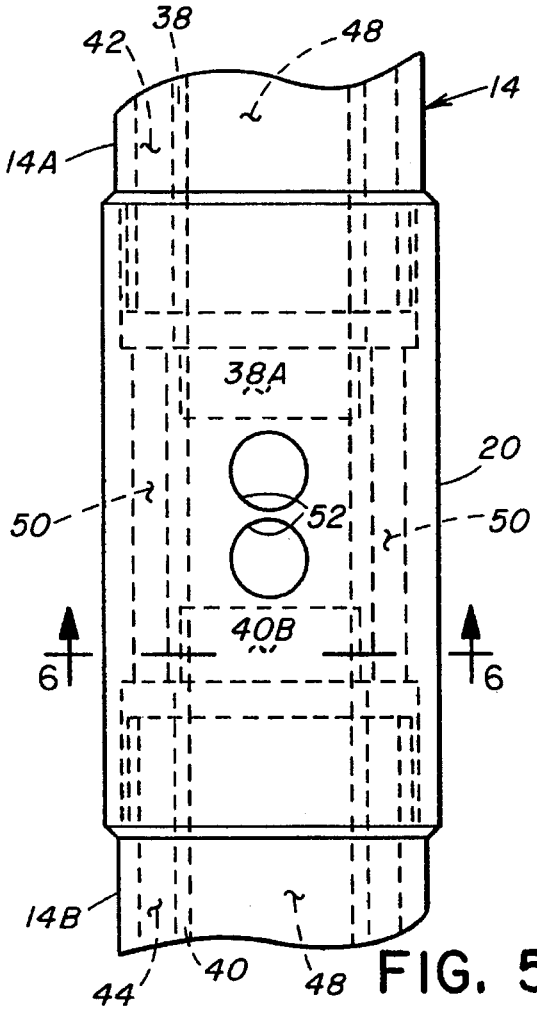
Figure 6:
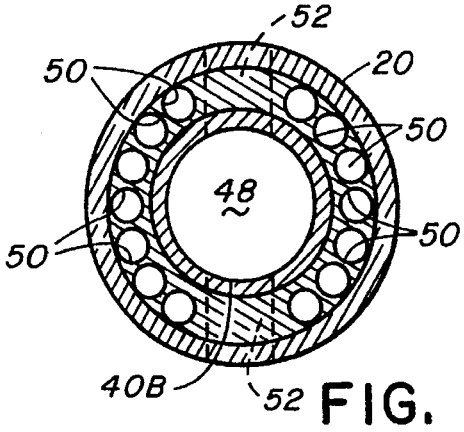
FIG. 6 is a cross-sectional view of a middle collar of the above production disposal tool of the present invention taken along line 6—6 in FIG. 5.

As illustrated in FIGS. 5 and 6, the middle collar 20 includes a plurality of axial passageways 50 spaced outwardly from the central interior passage 48 extending through the middle collar 20 and extending generally parallel to and being circumferentially spaced from one another about the central interior passage 48. The axial passageways 50 extend between and interconnect with and thus provide communicate between the upper and lower inner annular passages 42, 44. The lighter desired fluids L in the outer lower annulus 26C flow upwardly and enter the lower inner annular passage 44 through the inlet port holes 36 of the lower collar 24 and flow upward through the lower inner annular passage 44 and therefrom upward through the axial passageways 50 into and upward through the upper inner annular passage 42 and out the outlet port holes 34 of the upper collar 22 and into the outer upper annulus 26A. Thus, the lighter desired fluids L flow from the production formation P into the outer lower annulus 26C and upward to the outer upper annulus 26A and then further upward to the ground surface G, by-passing the upper and lower packer seals 28, 30, the outer middle annulus 26B and the disposal formation D.

The middle collar 20 also includes a plurality of transverse ports 52 that extend between and interconnect the central interior passage 48 through the middle collar 20 and outer middle annulus 26B defined about the middle collar 20 and thus provides communication from the central interior passage 48 to the outer middle annulus 26B. More particularly, there are two pairs of such transverse ports 52 located 180 degrees apart. Of course as is readily shown in FIG. 6, there are no axial passages 50 defined at the locations of the transverse ports 52.

Referring to FIGS. 1 and 2, the tubing pump 32 includes an intake port 54 that is below the level of the productive formation P and communicates with the interior passage 48. Preferably, the tubing pump 32 also includes a lower plunger body 56, an upper plunger body 58, a lower connecting rod 60 extending between and attaching the lower plunger body 56 to the upper plunger body 58, an upper connecting rod 62 extending between and attaching the upper plunger body 58 to a pump drive unit 64 above the ground surface G, and a standing valve 66. The lower plunger body 56 is disposed within the lower tube member 18 and the upper plunger body 58 is disposed within the upper tube member 16. Both the lower and upper plunger bodies 56, 58 are reciprocally movable along the lower and upper tube members 18, 16 such that the latter constitute outer barrels of the pump 32. The lower connecting rod 60 extends through the interior passage 48 of the upper and lower inner by-pass tubes 38, 40 and the middle collar 20. The pump drive unit 64, which takes the form of a mechanism well-known to one of ordinary skill in the art, repetitively drives the upper and lower plunger bodies 58, 56 reciprocally along respective upstrokes and downstrokes.

The lower plunger body 56 has a valve mechanism 68 which is closed on the upstroke to prevent undesired fluids H from flowing downward through the lower plunger body 56 and open on the downstroke to allow undesired fluids H to flow upward through the lower plunger body 56. On both the upstroke and downstroke, the upper plunger body 58 seals the interior passage 48 and prevents undesired fluids H from flowing further upward in the upper tube member 16. The standing valve 66 is located between the lower plunger body 56 and the intake port 54 and is open on the upstroke to allow undesired fluids H to enter the interior passage 48 and closed on the downstroke to prevent undesired fluids H from exiting the interior passage 48 into the outer lower annulus 26C. A mud anchor 70 may be disposed about the intake port 54 to anchor the tubing string 12 in the well bore B and prevent mud from blocking the intake port 54.

Also, as seen in FIGS. 1 and 2, a tubing anchor 72 is mounted on the tubing string 12 above the tool 10 to engage the well casing C without obstructing upward flows through the outer upper annulus 26A. The tubing anchor 72 centralizes the string 12 in the well W so that its weight is distributed evenly about the packer seals 28, 30 and up and down movement of the string 12 is prevented so as to reduce wear of the packer seals.

Thus, the above production disposal tool 10 having the aforementioned construction disposes of undesired fluids H in the disposal formation D as follows. Undesired fluids H from the productive formation enter the outer lower annulus 26C and are separated from the lighter desired fluids L by gravity. The undesired fluids H flow downward in the well bore B. On the upstroke of the tubing pump 32, a quantity of the undesired fluids H is drawn through the intake port 54 and standing valve 66 into the interior passage 48. On the downstroke, the standing valve 66 closes sealing the bottom of the interior passage 48. The valve mechanism 68 on the lower plunger body 56 opens allowing the undesired fluids H in the interior passage 48 to flow through the lower plunger body 56. The upper plunger body 58 simultaneously forces the undesired fluids H out the transverse ports 52 into the outer middle annulus 26B where they enter disposal formation D through the openings O in the well casing C. On the next succeeding upstroke the above actions are repeated. It should also be understood that the tool 10 can be used for water flooding repressurizing of production zones by simply pumping water from a lower formation up into the desired water flood formation.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. An above production disposal tool for use within a casing of a production well having a lower productive formation and an upper disposal formation, said tool comprising:

(a) an outer tube body disposed in the well casing such that an outer middle annulus is defined between said outer tube body and the well casing, said outer tube body extending along the disposal formation;

(b) a pair of spaced upper and lower sealing means for forming respective upper and lower annular seals between said outer tube body and the well casing, said spaced upper and lower sealing means disposed about spaced upper and lower tube portions of said outer tube body above and below the disposal formation and at opposite ends of said outer middle annulus;

(c) upper means disposed in the well casing and being attached to said upper tube portion of said outer tube body and extending upwardly therefrom above said upper annular sealing means such that an outer upper annulus is defined between said upper means and the well casing, said upper means defining a plurality of outlet port holes for discharging a desired lighter fluid flowing upwardly from said outer tube body through said upper means and into said outer upper annulus for discharge up the well casing and from the well;

(d) lower means disposed in the well casing and being attached to said lower tube portion of said outer tube body and extending downwardly therefrom below said lower annular sealing means such that an outer lower annulus is defined between said lower means and the well casing, said lower means defining a plurality of inlet port holes for receiving the desired lighter fluid flowing upwardly in said outer lower annulus from the production formation and into said lower means and therefrom to said outer tube body;

(e) an upper inner by-pass tube disposed in said outer tube body and having an upper end portion extending into said upper means, said inner by-pass tube defining an upper inner annular passage between said outer tube body and said upper inner by-pass tube communicating with said outlet port holes defined in said upper means;

(f) a lower inner by-pass tube disposed in said outer tube body and having a lower end portion extending into said lower means, said lower inner by-pass tube defining a lower inner annular passage between said outer tube body and said lower inner by-pass tube communicating with said inlet port holes defined in said lower means;

(g) middle means incorporated in said outer tube body between said upper and lower tube portions thereof and adjacent to said outer middle annulus, said middle means having (i) a plurality of axial passageways defined therein communicating with and interconnecting said upper and lower inner annular passages so that the desired lighter fluid from the productive formation may flow from said outer lower annulus below said lower annular sealing means inward through said inlet port holes of said lower means, upward through said lower and upper inner annular passages, and outward through said outlet port holes of said upper means into said upper outer annulus above said upper annular sealing means, and (ii) a plurality of transverse ports defined therein communicating with an interior passage defined by said upper and lower means and said upper and lower inner by-pass tubes to permit flow of an undesired heavier fluid from within said interior passage outward through said middle means into said outer middle annulus and the disposal formation; and (h) pumping means disposed in the well casing and incorporated in said lower and upper means and said outer tube body and communicating with said interior passage, said pumping means for receiving the undesired heavier fluid flowing downwardly by gravity into said outer lower annulus from the productive formation and for pumping the undesired fluid upwardly through said interior passage and out said transverse ports into said outer middle annulus and the disposal formation concurrently as desired lighter fluids flow upwardly from the productive formation through said outer lower annulus and into said inlet port holes of said lower means.

2. The tool of claim 1 wherein said upper means is an upper tube member attached to said upper tube portion of said outer tube body and extending upwardly therefrom above said upper annular sealing means such that said outer upper annulus is defined between said upper tube member and the well casing, said upper tube member including an upper collar having said outlet port holes defined therein for discharging the desired lighter fluid flowing upwardly in said outer tube body into said outer upper annulus for discharge up the well casing and from the well.

3. The tool of claim 1 wherein said lower means is a lower tube member attached to said lower tube portion of said outer tube body and extending downwardly therefrom below said lower annular sealing means such that said outer lower annulus is defined between said lower tube member and the well casing, said lower tube member including a lower collar having said inlet port holes defined therein for receiving the desired lighter fluid flowing upwardly in said outer lower annulus from the production formation located below said lower collar.

4. The tool of claim 1 wherein said pumping means includes:

a lower intake port disposed below the productive formation for receiving the undesired fluid through said intake port into said interior passage and out said transverse ports into said outer middle annulus and the disposal formation;

a lower plunger body disposed within said lower means for reciprocal movement therealong;

an upper plunger body disposed within said upper means for reciprocal movement therealong, said upper plunger body forming a seal in said interior passage through said upper means past which the undesired heavier fluid may not flow further upward; and an elongated rod disposed within said interior passage interconnecting said lower plunger body to said upper plunger body.

5. The tool of claim 4 wherein said pumping means also includes another elongated rod interconnecting said upper plunger body to means for reciprocating said lower and upper plunger bodies along an upstroke and a downstroke.

6. The tool of claim 5 wherein said pumping means also includes a standing valve located below said lower plunger body which is open on said upstroke to allow the undesired heavier fluid to flow into said interior passage and closed on said downstroke to seal the bottom of said interior passage so that the undesired heavier fluid is forced through said transverse ports of said middle collar on said downstroke.

7. The tool of claim 6 wherein said lower plunger body has valve means which is closed during said upstroke and open during said downstroke to allow the undesired heavier fluid to flow upward through said lower plunger body only on said downstroke.

8. The tool of claim 1 wherein said upper and lower annular sealing means are a pair of upper and lower packer seals each of which is attached on said upper and lower tube portions of said outer tube body.

9. An above production disposal tool for use within a casing of a production well having a lower productive formation and an upper disposal formation, said tool comprising:

(a) an outer tube body disposed in the well casing and forming a part of a tubing string such that an outer middle annulus is defined between said outer tube body and the well casing, said outer tube body extending along the disposal formation;

(b) a pair of spaced upper and lower sealing means for forming respective upper and lower annular seals between said outer tube body and the well casing, said spaced upper and lower sealing means disposed about spaced upper and lower tube portions of said outer tube body above and below the disposal formation and at opposite ends of said outer middle annulus;

(c) an upper tube member disposed in the well casing and forming another part of said tubing string, said upper tube member being attached to said upper tube portion of said outer tube body and extending upwardly therefrom above said upper annular sealing means such that an outer upper annulus is defined between said upper tube member and the well casing, said upper tube member including an upper collar having a plurality of outlet port holes defined therein for discharging a desired lighter fluid flowing upwardly from said outer tube body through said upper tube member and into said outer upper annulus for discharge up the well casing and from the well;

(d) a lower tube member disposed in the well casing and forming still another part of said tubing string, said lower tube member being attached to said lower tube portion of said outer tube body and extending downwardly therefrom below said lower annular sealing means such that an outer lower annulus is defined between said lower tube member and the well casing, said lower tube member including a lower collar having a plurality of inlet port holes defined therein for receiving the desired lighter fluid flowing upwardly in said outer lower annulus from the production formation located below said lower collar;

(e) an upper inner by-pass tube disposed in said outer tube body and having an upper end portion extending into said upper collar said upper inner by-pass tube defining an upper inner annular passage between said outer tube body and said upper inner by-pass tube communicating with said outlet port holes defined in said upper collar;

(f) a lower inner by-pass tube disposed in said outer tube body and having a lower end portion extending into said lower collar, said lower inner by-pass tube defining a lower inner annular passage between said outer tube body and said lower inner by-pass tube communicating with said inlet port holes defined in said lower collar;

(g) a middle collar incorporated in said outer tube body between said upper and lower tube portions thereof and adjacent to said outer middle annulus, said middle collar having (i) a plurality of axial passageways defined therein communicating with and interconnecting said upper and lower inner annular passages so that the desired lighter fluid from the productive formation may flow from said outer lower annulus below said lower annular sealing means inward through said inlet port holes, upward through said lower and upper inner annular passages, and outward through said outlet port holes into said upper outer annulus above said upper annular sealing means, and (ii) a plurality of transverse ports defined therein communicating with an interior passage defined by said upper and lower tube members and said upper and lower inner by-pass tubes to permit flow of an undesired heavier fluid from within said interior passage outward through said middle collar into said outer middle annulus and the disposal formation; and (h) pumping means disposed in the well casing and incorporated in said lower and upper tube members and said outer tube body of said tubing string and communicating with said interior passage, said pumping means for receiving the undesired heavier fluid flowing downwardly by gravity into said outer lower annulus from the productive formation and for pumping the undesired fluid upwardly through said interior passage and out said transverse ports into said outer middle annulus and the disposal formation concurrently as desired lighter fluids flow upwardly from the productive formation through said outer lower annulas and into said inlet port holes of said lower collar.

10. The tool of claim 9 wherein said pumping means includes a lower intake port disposed below the productive formation for receiving the undesired fluid through said intake port into said interior passage and out said transverse ports into said outer middle annulus and the disposal formation.

11. The tool of claim 9 wherein said pumping means includes a lower plunger body disposed within said lower tube member for reciprocal movement therealong.

12. The tool of claim 11 wherein said pumping means also includes an upper plunger body disposed within said upper tube member for reciprocal movement therealong, said upper plunger body forming a seal in said interior passage through said upper tube member past which the undesired heavier fluid may not flow further upward.

13. The tool of claim 12 wherein said pumping means also includes an elongated rod disposed within said interior passage interconnecting said lower plunger body to said upper plunger body.

14. The tool of claim 13 wherein said pumping means also includes another elongated rod interconnecting said upper plunger body to means for reciprocating said lower and upper plunger bodies along an upstroke and a downstroke.

15. The tool of claim 14 wherein said pumping means also includes a standing valve located below said lower plunger body which is open on said upstroke to allow the undesired heavier fluid to flow into said interior passage and closed on said downstroke to seal the bottom of said interior passage so that the undesired heavier fluid is forced through said transverse ports of said middle collar on said downstroke.

16. The tool of claim 15 wherein said lower plunger body has valve means which is closed during said upstroke and open during said downstroke to allow the undesired heavier fluid to flow upward through said lower plunger body only on said downstroke.

17. The tool of claim 9 wherein said upper and lower annular sealing means are a pair of upper and lower packer seals each of which is attached on said upper and lower tube portions of said outer tube body.

18. The tool of claim 9 wherein:

said upper inner by-pass tube is attached at an upper end to said upper collar and at a lower end to said middle collar; and said lower inner by-pass tube is attached at a lower end to said lower collar and at an upper end to said middle collar.

19. The tool of claim 18 further comprising:

annular seal rings disposed about said upper and lower ends of said upper and lower inner by-pass tubes to prevent leakage of the desired lighter fluid from said upper and lower inner annular passages into said interior passage where said upper and lower inner by-pass tubes are attached to said respective collars.

* * * * *